US005771846A

United States Patent [19]

Ruchti

[11] Patent Number: 5,771,846

[45] Date of Patent: Jun. 30, 1998

[54] METHOD FOR FEED WATER CONTROL IN WASTE HEAT STEAM GENERATORS

[75] Inventor: Christoph Ruchti, Uster, Switzerland

[73] Assignee: Asea Brown Boveri AG, Baden, Switzerland

[21] Appl. No.: 620,331

[22] Filed: Mar. 22, 1996

[30] Foreign Application Priority Data

Mar. 23, 1995 [DE] Germany ..... 195 10 619.9

[51] Int. Cl.[6] ..... F22D 5/30

[52] U.S. Cl. ..... 122/451 R; 60/39.182; 60/665

[58] Field of Search ..... 122/451 R; 60/39.182, 60/665, 667

[56] References Cited

U.S. PATENT DOCUMENTS

| | | | |
|---|---|---|---|
| 4,353,204 | 10/1982 | Arakawa | 60/39.182 |
| 4,516,403 | 5/1985 | Tanaka | 60/667 |
| 4,619,224 | 10/1986 | Takita et al. | 122/451 R |
| 4,854,121 | 8/1989 | Arii et al. | 122/7 R |
| 5,148,775 | 9/1992 | Peet | 122/451 R |
| 5,575,244 | 11/1996 | Dethier | 122/448.1 |

OTHER PUBLICATIONS

Patents Abstracts of Japan, M–1005, Aug. 2, 1990, vol. 14, No. 357.

Patents Abstracts of Japan, M–1073, Jan. 25, 1991, vol. 15, No. 32.

G. Klefenz, "Die Regelung von Dampfkraftwerken", pp. 108–113.

Karl Joachim Thomé–Kozmiensky, "Thermische Abfallbehandlung", pp. 404–405, 1994.

*Primary Examiner*—Henry A. Bennett
*Assistant Examiner*—Gregory A. Wilson
*Attorney, Agent, or Firm*—Burns, Doane, Swecker & Mathis, L.L.P.

[57] ABSTRACT

In a method for feed water control in waste heat steam generators, in particular drum boilers with a circulating pump (9) and drum boilers with natural circulation employed in combination power plants, wherein, by a three-component control by means of a superordinated level regulator (13) and a flow-through regulator (14) subordinated to the level regulator (13), the set value ($S_{in}$) of the flow-through regulator (14) is displaced by the level regulator (13) in such a way that the level in the drum (6) is always regulated to the set value (S), regardless of interfering effects, the flow-through regulator (14) for the feed water flow ($\dot{m}_s$) is guided by the heat amount ($\dot{Q}_{AG}$) in the exhaust gas flow. The output signal of the flow-through regulator (14) for the feed water flow ($m_s$) is limited, wherein as the function of the heat amount ($\dot{Q}_{AG}$) in the exhaust gas flow a selection is made between a limit value ($\dot{m}_1$) for the start-up operation and a limit value ($\dot{m}_2$) for normal control operation and the switch from ($\dot{m}_1$) to ($\dot{m}_2$) takes place via a time function element (16) with an idle time (T).

4 Claims, 3 Drawing Sheets

METHOD FOR FEED WATER CONTROL IN WASTE HEAT STEAM GENERATORS

FIELD OF THE INVENTION

The invention relates to a method for feed water control in waste heat steam generators, in particular drum boilers with a circulating pump and drum boilers with natural circulation employed in combination power plants, wherein the water level in the drum is controlled in accordance with the three-component control system.

BACKGROUND OF THE INVENTION

In a combination power plant, ambient air is aspirated and led through a filter system into the compressor of the gas turbine. The air is compressed there, subsequently mixed with fuel and burned in the combustion chamber. The exhaust gases being generated in the process drive the turbine. Electrical energy is generated by means of the generator coupled with the gas turbine.

The hot waste gases from the gas turbine reach the waste heat boiler via the exhaust gas conduit. There the greater part of the still present heat is removed from them and transferred to a water/steam circulation before they reach the atmosphere through a chimney. The waste heat boiler consists of various heat exchange elements. First, the water is heated to almost saturation temperature in the economizer. It is then converted to steam in the evaporator. The saturated steam is subsequently further heated in the superheater. The obtained live steam then reaches the steam turbine where it is expanded. In the process thermal energy is converted into mechanical energy. The steam turbine itself is coupled with a generator which generates steam.

After leaving the steam turbine, the exhaust steam is converted into water. This is fed into the feed water tank, in which the non-condensable gases are also removed. The feed water tank absorbs the fluctuations in volume in the water/steam circulation. The water is returned under pressure via feed water pumps into the waste heat boiler.

The demands on the quality of the steam generation regulation are very great in the above described case, because the highest degree of availability is demanded. Furthermore, rapid output changes of the gas turbine have to be controlled. Besides the steam temperature regulation at the boiler outlet, a feed water control is mainly required in order to obtain optimum filling of the boiler with feed water. In case of deviations of the drum level from the set value, the feed water flow is more or less strongly throttled. The term feed water control circuit is not quite correct, because the feed water flow is only the regulated quantity for regulating the water level in the drum, but this term is usually employed.

A three-component control system (G. Klefenz: "Die Regelung von Dampfkraftwerken" [Control of Steam Power Plants], Biblio- graphisches Institut Mannheim/Wien/Z ürich, B.I.-Wissenschafts-verlag, 1983, p. 111) of the feed water control circuit for drum boilers is known wherein, besides the drum water level, the temperature-corrected steam and feed water flow is also included in the control as a regulated quantity. As described by K. J. Thomé-Kozmiensky in "Thermische Abfallbehandlung" [Treatment of Thermal Waste], EF-Verlag für Energy-und Umwelttechnik, Berlin, 1994, p. 404, the drum water level is constant when the steam and feed water flow are balanced. The difference is applied to the input of the regulator, wherein the feed water flow is the regulated quantity in this case and the steam flow is the control input determining the set value. The water level is only applied correctively.

The drum water level is set in that the height of the drum water is measured and regulated by means of a supply water control valve as the regulating member. In case of a sudden load change, the difference between the steam and feed water flow is immediately compensated. The level regulator itself only reacts slowly for precise correction. Its speed is limited by the turbulence of the level measurement, which require appropriate damping, and mainly by the filling time of the drum and the evaporator.

In a modified circuit (see FIG. 1, prior art), the level is always regulated to the desired set value, regardless of all interfering effects. A subordinated flow-through regulator (for example a P- or PD-regulator) for the feed water flow is guided by the steam flow. In addition, the set value of the flow-through regulator is displaced by a superordinated level regulator (for example a PI- or PID-regulator) so that the level, i.e. the height of the water level in the drum, is regulated to the desired value. Thus, all inconsistencies in the signals of the steam and feed water flow possibly still present are corrected by this regulator.

The flow-through measurement of the live steam or the saturated steam used in accordance with the prior art in the course of three-component control systems has a number of disadvantages. A live steam measurement is expensive and causes an undesired pressure drop, which reduces the output of the installation. Furthermore, the concept of the three-component control system based on a mass flow balance fails during start-up operations, wherein the mass content of the evaporator changes significantly. The steam bubbles being created in the evaporator, which was previously filled with water, eject a large portion of the water. In this phase the information provided by the live steam measurement is meaningless, so mostly a switch is made to single- or double-component control. Such structural changes in the control circuit are hard to control.

OBJECT AND SUMMARY OF THE INVENTION

By means of the invention it is intended to avoid all these disadvantages. It is the object of the invention to provide a uniform level regulation by means of the three-component control system in waste heat steam generators, in particular drum boilers of the above mentioned type for combined power plants, which does not cause a pressure drop, and which accomplishes the transition from the start-up operation to controlled load operation without structural changes in the control.

In accordance with the invention in a method for the feed water control in waste heat steam generators, in particular drum boilers with a circulating pump and drum boilers with natural circulation, which are employed in combination power plants wherein, by means of a three-component control system with a superordinated level regulator and a flow-through regulator subordinated to the level regulator for the feed water flow, the set value of the flow-through regulator is displaced by the level regulator in such a way that the water in the drum or bottle is always regulated to the set value, regardless of interference effects, this is attained in that the flow-through regulator for the feed water flow is guided by the amount of heat in the exhaust gas flow from the gas turbine.

The advantages of the invention are to be found, among others, in the omission of the flow-through measurement, customary up to now, of the saturated steam or the live steam. Because of this it is possible to prevent the pressure drop caused by the measurement, which leads to a reduction in the output of the installation. It is furthermore possible to omit the measuring nozzles, required in accordance with the prior art, but which are expensive. The amount of heat in the exhaust gas flow, which is used for control in place of the steam flow, is available in the gas turbine control, so that the control outlay is reduced.

It is practical if the output signal of the flow-through regulator for the feed water flow is limited, wherein as the function of the amount of heat in the exhaust gas flow a selection is made between a limit value during start-up operation and a limit value for normal control operation. Switching from the start-up limit value to the normal limit value is performed via a time function element with an idle time corresponding to the length of the start-up until the termination of the water ejection. This has the advantage that the generally customary structural switch can be avoided. The amount of heat in the exhaust gas flow can be used to determine a maximum feed water flow which satisfies the differing requirements during start-up and during operation under load.

BRIEF DESCRIPTION OF THE DRAWINGS

The invention is described in conjunction with an exemplary embodiment including a feed water control circuit (three-component control system) of a drum boiler with a circulating pump, which is used in a combination power plant, is represented in the drawings. Only the elements required for understanding the invention are shown. The feed water tank, the compressor and the turbines of the combination power plant, for example, are not represented.

The invention will be explained in detail below by means of exemplary embodiments and drawing FIGS. 1 to 3, in which.

DETAILED DESCRIPTION OF PREFERRED EMBODIMENTS

Figure 1:
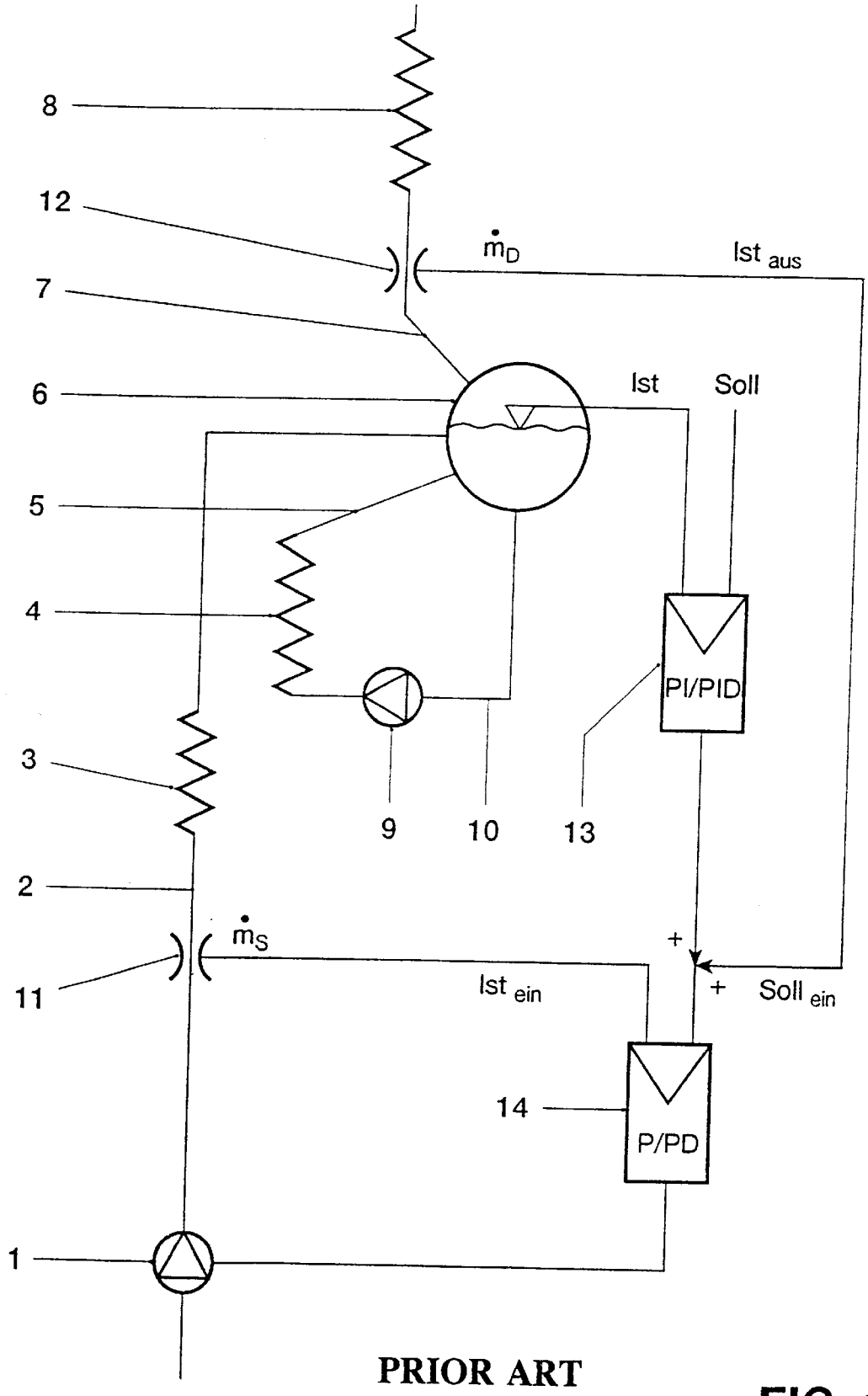
PRIOR ART FIG. 1
FIG. 1 represents a control diagram for the feed water control of a drum boiler with a circulating pump in accordance with the prior art.

FIG. 1 shows the control diagram for the feed water circulation in a drum boiler by means of a three-component control in accordance with the prior art.

Feed water is conducted via the feed water pump 1 in the feed water line 2 from a feed water tank, not shown here, into the economizer 3, in which it is heated almost to saturation temperature and is then conducted into the drum 6. Water from the drum 6 reaches the evaporator 4 through the down pipes 10 and the circulating pump 9, where it partially evaporates because of the supply of heat from the exhaust gas flow. From the evaporator 4, the water-steam mixture reaches the drum 6 through the line 5, where the water is separated. The saturated steam is conducted via the line 7 into the superheater 8 and is further heated there in order to then reach the turbine, not shown, in the form of live steam. The feed water flow amount $\dot{m}_s$ is measured by means of the flow-through measuring nozzle 11, and the steam flow amount $\dot{m}_D$ with the aid of the flow-through measuring nozzle 12.

The filling of the drum 6 is affected by the feed water flow $\dot{m}_s$ supplied. An actual signal corresponding to the drum level is compared with the set value signal, and the difference is applied to a proportional-integrally operating PI-regulator or a PID-regulator 13.

A control signal $I_{in}$ derived from the feed water drum measurement is supplied to a second flow-through regulator 14 (P- regulator or PD-regulator), which is subordinated to the level regulator 13, and is compared with the set signal $S_{in}$. The set signal $S_{in}$ is formed from a signal $I_{out}$ corresponding to the steam flow amount $m_D$, which is further displaced by the superordinated level regulator 13 in such a way that the level, i.e. the height of the water level in the drum 6 is set to the desired value regardless of all interference effect values. The difference between $I_{in}$ and $S_{in}$ is then applied to the proportionally operating regulator 14 or the PD-regulator 14, which then regulates the feed water flow amount $\dot{m}_s$. In most cases this is done via a feed water regulating valve, which was not particularly emphasized in FIG. 1.

Thus all possibly present discrepancies in the signals of the steam and feed water flows are corrected by this regulator 14.

The three-component control in FIG. 1 in accordance with the present prior art has a number of disadvantages, which have already been mentioned above. These can be eliminated by means of the solution in accordance with the invention represented in FIG. 2.

Figure 2:
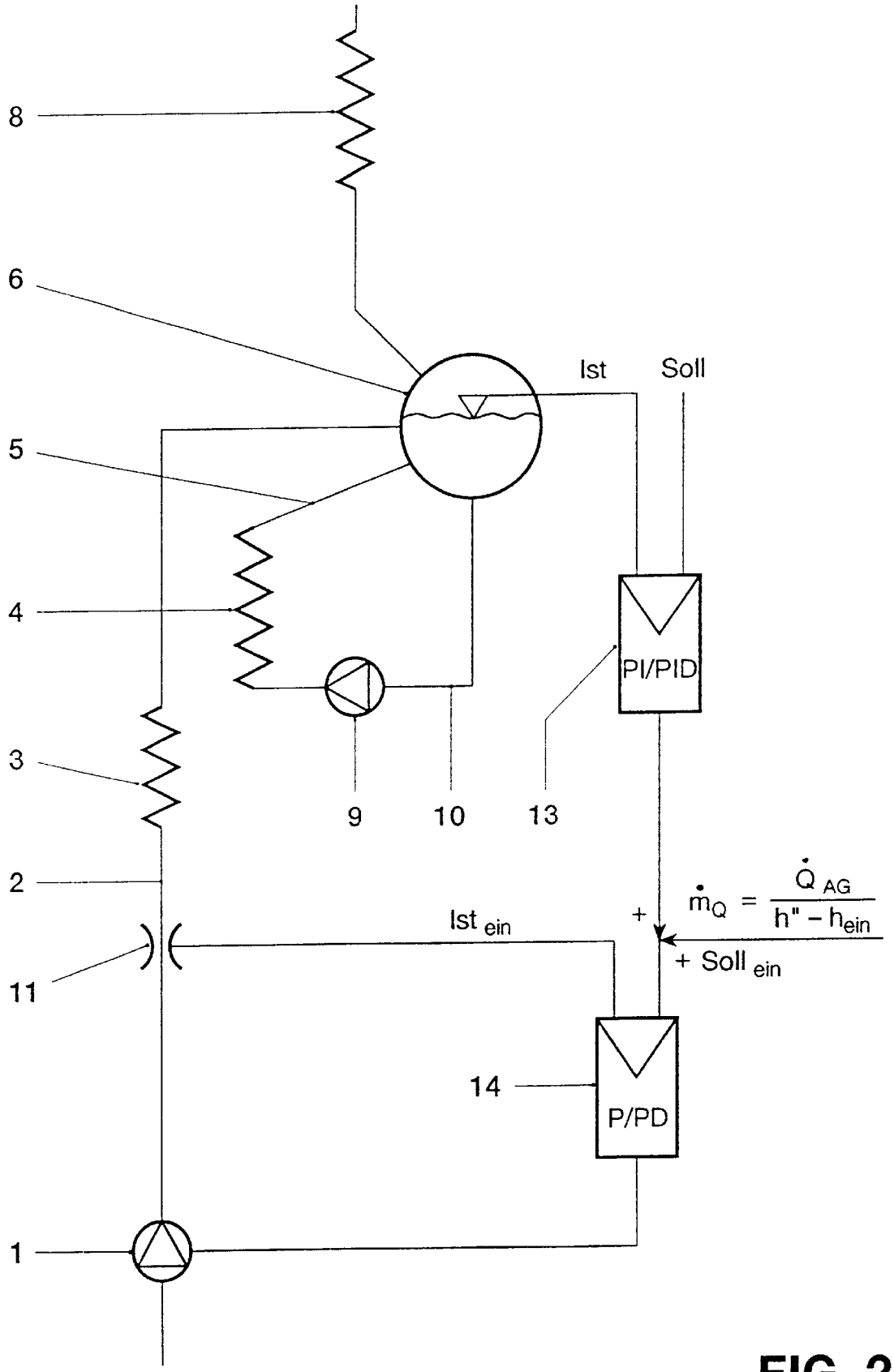
FIG. 2 represents a control diagram for the feed water control of a drum boiler with a circulating pump in accordance with the invention.

FIG. 2 shows a control diagram for the feed water control of a waste heat drum boiler with a circulating pump 9 in accordance with the invention. In contrast to FIG. 1, the set value $S_{in}$ of the flow-through regulator 14 is no longer determined from the signal $I_{out}$ derived for the steam flow amount $m_D$, but from a signal $I'_{out}$, which is derived from the heat amount in the exhaust gas flow $\dot{Q}_{AG}$.

The heat amount in the exhaust gas flow $\dot{Q}_{AG}$ is available in the gas turbine control, because the temperature of the exhaust gas is a regulated value for the operation of the gas turbine and therefore known. Since the drum pressure is also known, the enthalpy of the saturated steam h" is also known. Also known is the pressure and the temperature and thus the enthalpy $h_{in}$ of the feed water flow. For practical purposes the difference $h''-h_{in}$ is a function of the drum pressure described by a few support values, so that the heat amount of the exhaust gas flow $\dot{Q}_{AG}$ is directly proportional to the amount of saturated steam or live steam. Therefore the heat amount of the exhaust gas flow is very well suited to regulating the feed water circulation.

Figure 3:
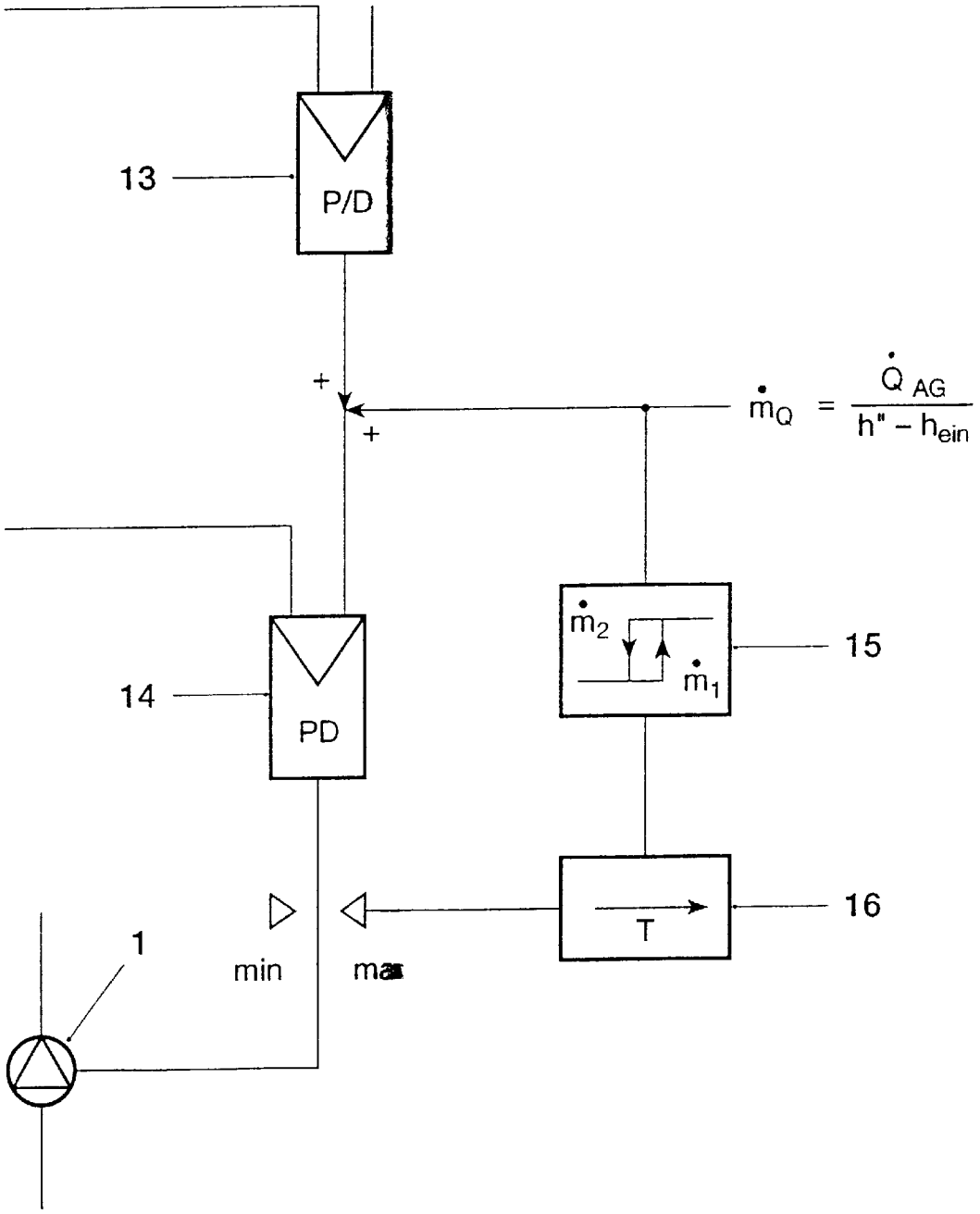
FIG. 3 is a detailed control diagram showing the arrangements for the start-up operation.

The main characteristics of the regulation concept for controlling the start-up process are shown in FIG. 3. The same regulators 13 and 14 are used as in normal load operation, so that no structure change of the control takes place. The only step necessary consists in a limitation of the maximally permissible feed amount at the output of the regulator 14. In normal control operations this limit value $\dot{m}_2$ is slightly less than the capacity of the feed pump 1. During start-up operation a limit to a much smaller limit value $m_1$, is used which, for example, is approximately 10% of the steam flow under full load. This value $\dot{m}_1$ is purposely kept lower than the average value of $\dot{m}_Q$ during start-up. Therefore the water level in the drum 6 which, from the start has been purposely kept low, cannot be replenished by the feed control. This takes place in the expectation of the water ejection from the evaporator 4 which inevitably arises because of the volume displacement of the freshly formed steam. The switch from the start-up limit value $\dot{m}_1$ to the normal limit value $\dot{m}_2$ is performed in the simplest way by means of a time function element 16 with an idle time T. The idle time T corresponds to the length of the start-up process until the water ejection is terminated.

The invention is obviously not limited to the exemplary embodiment shown here. It can also be employed in drum boilers with natural circulation.

What is claimed is:

1. A method for feed water control in waste heat steam generators, in particular drum boilers with a circulating pump and drum boilers with natural circulation employed in combination power plants, said method comprising:

providing a three-component control by means of a superordinated level regulator and a flow-through regulator subordinated to the level regulator, displacing a set value ($S_{in}$) of the flow-through regulator by the level regulator in such a way that the water level in the drum is always regulated to a constant set value (S), regardless of interfering effects, guiding the flow-through regulator for the feed water flow ($\dot{m}_s$) by the heat amount ($\dot{Q}_{AG}$) in the exhaust gas flow of the gas turbine.

2. A method for feed water control in waste heat steam generators in accordance with claim 1, wherein an output signal of the flow-through regulator for the feed water flow ($\dot{m}_s$) is limited, wherein as the function of the heat amount ($\dot{Q}_{AG}$) in the exhaust gas flow a selection is made between a limit value ($\dot{m}_1$) for the start-up operation and a limit value ($\dot{m}_2$) for normal control operation.

3. A method for feed water control in waste heat steam generators in accordance with claim 1, wherein the switch from the start-up limit value ($\dot{m}_1$) to the normal limit value ($\dot{m}_2$) is performed via a time function element with an idle time (T) corresponding to the length of the start-up until the termination of the water ejection.

4. A method for feed water control in waste heat steam generators in accordance with claim 2, wherein the switch from the start-up limit value ($\dot{m}_1$) to the normal limit value ($\dot{m}_2$) is performed via a time function element with an idle time (T) corresponding to the length of the start-up until the termination of the water ejection.

* * * * *